United States Patent [19]

Mueller et al.

[11] Patent Number: 4,680,954

[45] Date of Patent: Jul. 21, 1987

[54] GRIPPING DEVICES IN IDLING STAGE AREAS OF A TRANSFER PRESS

[75] Inventors: Sieghard Mueller, Ottenbach; Hermann Braun, Eislingen; Helmut Dumschat, Donzdorf; Hans-Juergen Trautwein, Goeppingen, all of Fed. Rep. of Germany

[73] Assignee: L. Schuler GmbH, Fed. Rep. of Germany

[21] Appl. No.: 835,277

[22] Filed: Mar. 3, 1986

[30] Foreign Application Priority Data

Mar. 23, 1985 [DE] Fed. Rep. of Germany ..... 3510697

[51] Int. Cl.[4] ..... B21D 43/05

[52] U.S. Cl. ..... 72/405; 72/422; 198/621

[58] Field of Search ..... 72/405, 421, 422; 198/621, 742; 414/751, 753

[56] References Cited

U.S. PATENT DOCUMENTS 3,029,710 4/1962 Fotsch et al. ..... 198/742
3,456,814 7/1969 Bautz ..... 414/751
4,042,093 8/1977 Fujii et al. ..... 198/742
4,557,370 12/1985 Tanaka ..... 198/621

FOREIGN PATENT DOCUMENTS 2254355 5/1974 Fed. Rep. of Germany ..... 72/422
3233102 5/1983 Fed. Rep. of Germany ..... 72/422
3336082 4/1984 Fed. Rep. of Germany ..... 72/422
3409035 9/1984 Fed. Rep. of Germany .

*Primary Examiner*—Daniel C. Crane
*Attorney, Agent, or Firm*—Barnes & Thornburg

[57] ABSTRACT

For avoiding collisions between the grippers (5) adapted to be moved out of the idling stage area and the grippers (4) disposed fixedly at interchangeable gripper rail partial sections (1) and work tool parts, the grippers (5) which are adapted to be moved out of the idling stage area, are raised into an upright position. The grippers (5) and the rotary adjusting drive (10) for the uprighting are adapted to be moved out of the idling stage area on a carriage (18-gripper mounting support) by way of an adjusting means (13) at the exchangeable gripper rail partial section.

3 Claims, 2 Drawing Figures

GRIPPING DEVICES IN IDLING STAGE AREAS OF A TRANSFER PRESS

Figure 1:
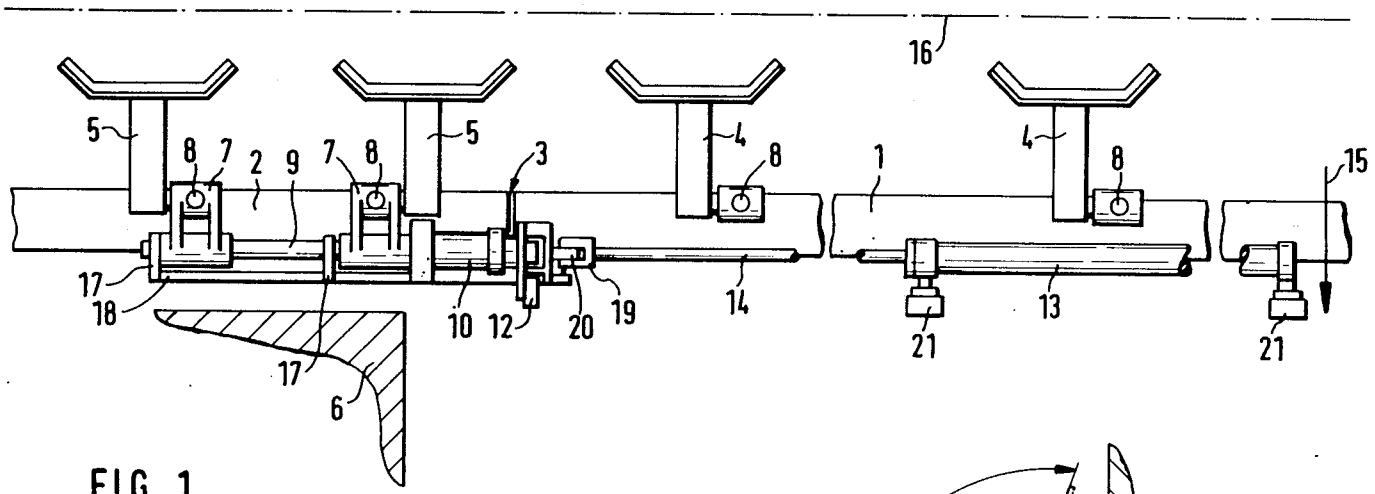

The present invention relates to a transfer press with gripper rails transmitting the transfer movement onto the workpieces, which are subdivided into interchangeable gripper rail partial sections and into gripper rail partial sections on the press side, with gripper arm mounting supports at least at individual interchangeable gripper rail partial sections displaceable by way of adjusting means in the longitudinal direction of the gripper rails into idling stage areas of the transfer press and with grippers attached at the gripper arm mounting supports.

Transfer presses have idling stage areas in which the workpieces are to be deposited without any deformation taking place thereat. The gripper rails carry for that purpose grippers which seize the workpieces in the preceding working stage and transfer the same into the idling stage area, and grippers which seize the workpieces in the idling stage area and transfer the same into the following working stage. The automation of the gripper change when changing over or refitting the transfer press, requires that the gripper rails carrying the grippers be moved out.The gripper rails are subdivided for that purpose. Since also the grippers in the idling stage areas have to be exchanged and newly installed, the grippers are appropriately exchanged together with the gripper rails adapted to be moved out.

A transfer press is disclosed in the DE-PS 32 33 102 with gripper rails which are subdivided into exchangeable gripper rail partial sections and into gripper rail partial sections remaining in the transfer press. Means for coupling together the gripper rail partial sections are provided in the gripper rail partial sections on the press side. Gripper arm mounting supports movable in the longitudinal direction of the gripper rails and carrying a gripper are secured at the interchangeable gripper rail partial sections. The displacement of each gripper arm mounting support into the idling stage of the transfer press and out of the idling stage takes place in dependence on the coupling movement of the gripper rail partial sections, and the gripper in the idling stage cannot be guided past, for example, the first gripper secured at the gripper rail partial section which is adapted to be moved out.

Divided gripper rails are disclosed in the DE-OS 33 36 082 with grippers which are adapted to be uprighted at the interchangeable gripper rail partial sections about a horizontal pivot axis extending transversely to the longitudinal dimension of the gripper rails. The disclosed construction is usable only for short transfer movements and small workpieces because longer gripper arm mounting supports together with the grippers would collide with the bridge part of the press columns and with the work tool upper part when pivoted out of the idling stage area.

With respect to the aforementioned disadvantages the same also apply to the installation disclosed in the DE-OS 34 09 035, in which one gripper each is adapted to be moved out and into the idling stage area by way of a lever system forming a quadrilateral link system.

None of these prior art installations utilize the rotation of the grippers disclosed in the DE-PS 22 54 355 which takes place in this prior art about a vertical axis of rotation and for the purpose of avoiding the gripper movement perpendicular to the transfer movement.

In contrast thereto, it is the object of the present invention to raise or put upright the grippers of the idling stage at the gripper arm mounting support in order to thus guide the grippers unimpaired past the fixed grippers disposed at the interchangeable gripper rail partial sections and at the work tool parts during the movement out of the idling stage.

The underlying problems are solved according to the present invention in that the grippers movable into the idling stage area are pivotally supported at the gripper arm mounting supports and the pivot axis of the grippers extends horizontally and in the direction of the length dimension of the gripper rails. One rotary adjusting drive operatively connected with the grippers is secured on each of the gripper arm mounting supports, and the rotary adjusting drives are adapted to be moved out of the idling stage area at the same time and together with the gripper arm mounting supports and the grippers by means of adjusting means.

If the adjusting means is a double acting pressure cylinder whose piston rod is secured at the gripper arm mounting support and if the pivot axis of the grippers extends coaxially to the piston rod, then the advantage can be achieved with the present invention that the rotary adjusting drive can be moved out together with the gripper arm mounting supports and the grippers so that separate coupling means between the rotary adjusting drive and the grippers can be dispensed with.

Figure 2:
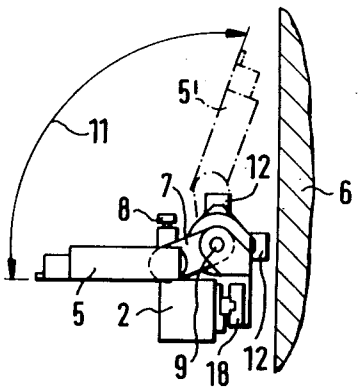

These and other objects, features and advantages of the present invention will become more apparent from the following description when taken in connection with the accompanying drawing, which shows, for purposes of illustration only, one embodiment in accordance with the present invention, and wherein:

FIG. 1 is a schematic view, on a reduced scale, of a subdivided gripper rail equipped with grippers in accordance with the present invention within the idling stage area; and FIG. 2 is a schematic end elevational view on the gripper rail in accordance with the present invention.

Referring now to the drawing wherein like reference numerals are used throughout the two views to designate like parts, the gripper rail is subdivided at 3 into an interchangeable gripper rail partial section 1 adapted to be moved out, for example with a sliding table carrying a work tool or a work tool set, and into a gripper rail partial section 2 remaining in the transfer press. The gripper rail partial section 2 is located within the area of press columns 6. The gripper rail partial section 1 carries grippers 4 which are securely but interchangeably attached thereto by means of fastening means 8. Furthermore, an adjusting means 13 constructed as a double acting pressure cylinder is secured at the gripper rail partial section 1 whose piston rod 14 engages by way of a fork-head 19 and an extension 20 at a gripper arm mounting supportor carriage 18 movable over rail guide means or at a rotary adjusting drive 10 carried by the carriage 18. The carriage 18, which serves as a gripper arm mounting support, is movable over the separating area 3 by means of the adjusting means 13. Bearings 17 are secured on the carriage 18 in which a shaft 9 of the rotary adjusting drive 10 is supported. The grippers 5 are secured at pivot levers 7 by means of fastening means 8 and are rotatable together with the shaft 9 adapted to be actuated by the adjusting drive 10. The arrow 15 (FIG. 1) indicates the interchangeability of the gripper rail partial section 1. The centerline 16 (FIG. 1) designates the center of the work tools. As a rule, two gripper rails are present for the transfer movement of the workpieces. The double arrow 11 (FIG. 2) indicates the position of the grippers 5 into a position 5' shown in dash and dotted lines into which the grippers are displaced beyond the vertical position when being moved out of and into the idling stage area located between the press columns 6. Reference numeral 12 (FIG. 2) designates sensors for monitoring the pivot position of the grippers 5 while reference numeral 21 (FIG. 1) designates sensors for the movement of the carriage 18 into and out of the idling stage area;

While we have shown and described only one embodiment in accordance with the present invention, it is understood that the same is not limited thereto but is susceptible of numerous changes and modifications as known to those skilled in the art and we therefore do not wish to be limited to the details shown and described herein but intend to cover all such changes and modifications as are encompassed by the scope of the appended claims.

We claim:

1. A transfer press for transferring workpieces to successive workstations, and having idling stage areas between workstations, comprising:

gripper rail means for transmitting a transfer movement in a longitudinal direction onto the workpieces, said gripper rail means being subdivided at a separating area into interchangeable gripper rail partial sections and gripper rail partial sections, said interchangeable gripper rail partial sections having first gripper means fixed thereto for gripping the workpieces;

gripper arm mounting means on said gripper rail means and displaceable in said longitudinal direction into the idling stage area of the transfer press:

adjusting means on said gripper rail means for movably adjusting the gripper arm mounting means in said longitudinal direction over said separating area;

second gripper means for gripping the workpieces pivotally supported on the gripper arm mounting means for pivoting about an axis extending in said longitudinal direction;

rotary adjusting drive means secured to the gripper arm mounting means, for pivoting the gripper means about said axis;

said adjusting means moving, at the same time, said gripper arm mounting means, said rotary adjusting drive means and said second gripper means over said separating area back and forth between said interchangeable gripper rail partial section and gripper rail partial section.

2. A transfer press according to claim 1, wherein said adjusting means moves said gripper arm mounting means linearly in said longitudinal directions.

3. A transfer press according to claim 1, wherein said rotary adjusting drive means pivots said gripper means between a horizontal and vertical position.

* * * * *